US006672937B1

(12) United States Patent
Motosko

(10) Patent No.: US 6,672,937 B1
(45) Date of Patent: Jan. 6, 2004

(54) MINIATURE TOY VEHICLE

(76) Inventor: Stephen J. Motosko, 132 Sand Dollar La., Sarasota, FL (US) 34242

( * ) Notice: Subject to any disclaimer, the term of this patent is extended or adjusted under 35 U.S.C. 154(b) by 0 days.

(21) Appl. No.: 10/328,518

(22) Filed: Dec. 23, 2002

(51) Int. Cl.[7] ..... A63H 17/00
(52) U.S. Cl. ..... 446/437; 446/465; 446/431
(58) Field of Search ..... 446/454, 456, 446/437, 431, 424, 427, 428, 465, 448, 441

(56) References Cited

U.S. PATENT DOCUMENTS

| | | | | |
|---|---|---|---|---|
| 2,597,094 A | | 5/1952 | Gutmann | |
| 3,000,137 A | | 9/1961 | Vine | |
| 3,176,429 A | | 4/1965 | Brown | |
| 3,629,680 A | | 12/1971 | Baynes | |
| 3,892,086 A | * | 7/1975 | Gay et al. | 446/486 |
| 4,112,615 A | | 9/1978 | Ishimoto | |
| 4,160,253 A | | 7/1979 | Mabuchi | |
| 4,466,214 A | | 8/1984 | Kulesza | |
| 4,563,626 A | | 1/1986 | Ohtake | |
| 4,571,197 A | | 2/1986 | Kulesza | |
| 4,739,232 A | | 4/1988 | Ishimoto | |
| 4,911,669 A | | 3/1990 | Parker | |
| 5,334,076 A | | 8/1994 | Shinozuka | |
| 5,609,510 A | * | 3/1997 | Stubenfoll et al. | 446/456 |

FOREIGN PATENT DOCUMENTS

| | | | | |
|---|---|---|---|---|
| GB | 463667 A | * | 4/1937 | A63H/17/02 |
| GB | 667328 A | * | 2/1952 | A63H/17/02 |
| GB | 1528841 A | * | 10/1978 | A63H/17/02 |
| GB | 2033766 A | * | 5/1980 | A63H/17/02 |
| GB | 2164263 A | * | 3/1986 | A63H/17/02 |
| JP | 09215871 A | * | 8/1997 | A63H/17/40 |

* cited by examiner

*Primary Examiner*—Derris H. Banks
*Assistant Examiner*—Urszula M Cegielnik
(74) *Attorney, Agent, or Firm*—Charles J. Prescott

(57) ABSTRACT

A miniature toy vehicle, preferably of the wireless control self-propelled type equipped to flip or upset another similar toy vehicle or object upon forward impact therewith. The preferred toy vehicle includes a molded toy car body supporting front and rear wheels, steering, a control circuit board, a drive motor and a battery. A front flipping member is supported by the car body having a forwardly distal portion at a height, when the flipping member is armed, for engagement beneath a lower side or end margin of another toy vehicle or an object. The flipping member will upwardly flip or upset the other toy car or object when a trigger member thereof strikes the other toy car or an object.

3 Claims, 5 Drawing Sheets

12'
10'
14
24
20
32
36
28
D
A
34
B
30
38
A
26
21
22
16a

12'
50
14'
20
21
22
56
54
52
26'

MINIATURE TOY VEHICLE

CROSS-REFERENCE TO RELATED APPLICATIONS

Not applicable

STATEMENT REGARDING FEDERALLY SPONSORED RESEARCH OR DEVELOPMENT

Not applicable

INCORPORATION-BY-REFERENCE OF MATERIAL SUBMITTED ON A COMPACT DISC

Not applicable

BACKGROUND OF THE INVENTION

1. Field of the Invention

This invention relates generally to miniature toy cars, and more particularly to a manually or self-propelled miniature toy car equipped to flip or upset another toy vehicle of similar size and shape or another object upon forwardly impact of the toy vehicle thereagainst.

2. Description of Related Art

Miniature toy cars have always been popular for small children playing on the floor and other support surfaces with such toy vehicles. These toy vehicles having distinctive outer car body shapes have traditionally included those which are manually propelled toy cars, those which are frictionally energized and maintained in motion by inertia wheels and, most recently, more sophisticated remote or wireless controlled steerable self-propelled toy cars whose direction and speed are regulated by a separate wireless control unit.

Examples of some of the prior art miniature toy cars are disclosed in the following U.S. Patents:

U.S. Pat. No. 4,911,669 to Parker

U.S. Pat. No. 4,571,197 to Kulesza

U.S. Pat. No. 3,176,429 to Brown

U.S. Pat. No. 4,466,214 to Kulesza

U.S. Pat. No. 2,597,094 to Gutmann

U.S. Pat. No. 3,000,137 to Vine

U.S. Pat. No. 4,160,253 to Mabuchi

U.S. Pat. No. 4,112,615 to Ishimoto

U.S. Pat. No. 3,629,680 to Baynes

U.S. Pat. No. 4,563,626 to Ohtake

U.S. Pat. No. 5,334,076 to Shinozuka

U.S. Pat. No. 4,739,232 to Ishimoto

U.S. Pat. No. 5,158,495 to Yonezawa

The present invention provides a miniature toy vehicle of the above type which is equipped with a forwardly positioned flipping or object upsetting mechanism which, when armed and impacting against another vehicle of similar shape and size or another object also of similar size and shape will, upon such forwardly impact thereagainst, engage beneath and flip or upset the other toy vehicle or object from a normal orientation. The preferred embodiment of the invention is directed to the wireless control miniature self-propelled toy vehicles whose velocity and steering direction is regulated by a separate wireless control unit which enhances the versatility and creativity of directing such a wireless control toy vehicle at and against another toy vehicle of similar size and shape in pursuit fashion.

BRIEF SUMMARY OF THE INVENTION

This invention is directed to a miniature toy vehicle, preferably of the wireless control self-propelled type equipped to flip or upset another similar toy vehicle or object upon forward impact therewith. The preferred toy vehicle includes a molded toy car body supporting front and rear wheels, steering, a control circuit board, a drive motor and a battery. A front flipping member is supported by the car body having a forwardly distal portion at a height, when the flipping member is armed, for engagement beneath a lower side or end margin of another toy vehicle or an object. The flipping member will upwardly flip or upset the other toy car or object when a trigger member thereof strikes the other toy car or an object.

It is therefore an object of this invention to provide a miniature toy vehicle equipped to flip or upset another toy vehicle or object of similar size and shape when impacted during forwardly motion of the toy vehicle.

It is still another object of this invention to provide a wireless miniature toy vehicle which is self-propelled and controlled in direction and speed so as to be steerable in pursuit fashion against another toy vehicle of similar size and shape or another object so as to trigger a spring-loaded flipping or upsetting mechanism attached to the forwardly end of the toy vehicle.

Still another object of this invention is to provide a challenging game of miniature toy car pursuit and evasion of self-propelled wireless controlled toy vehicles against one another wherein successful engagement of the forwardly end of one of the toy vehicles beneath and against a side or rearward lower margin of another such similar vehicle will trigger a flipping or upsetting mechanism which will cause the other impacted vehicle to be either flipped or upset off of its normal orientation atop a floor or flat play surface.

In accordance with these and other objects which will become apparent hereinafter, the instant invention will now be described with reference to the accompanying drawings.

BRIEF DESCRIPTION OF THE SEVERAL VIEWS OF THE DRAWING(S)

DETAILED DESCRIPTION OF THE INVENTION

Figure 1:
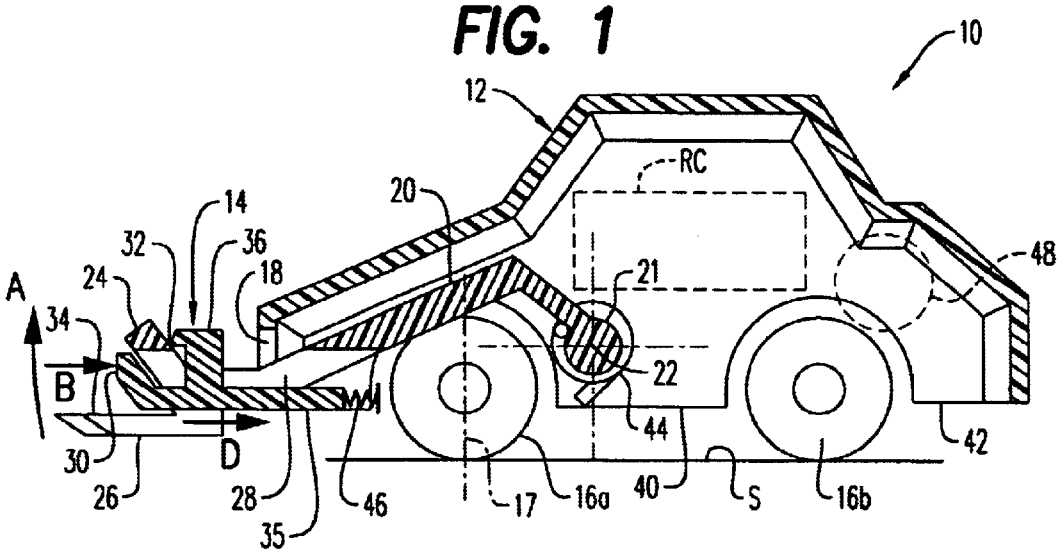
FIG. 1 is a side elevation simplified schematic view in section of the preferred embodiment of the invention.
Figure 2:
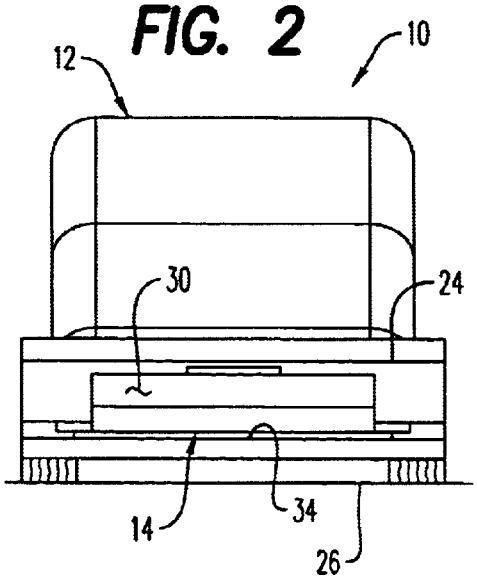
FIG. 2 is a front end elevation view of FIG. 1.
Figure 3:
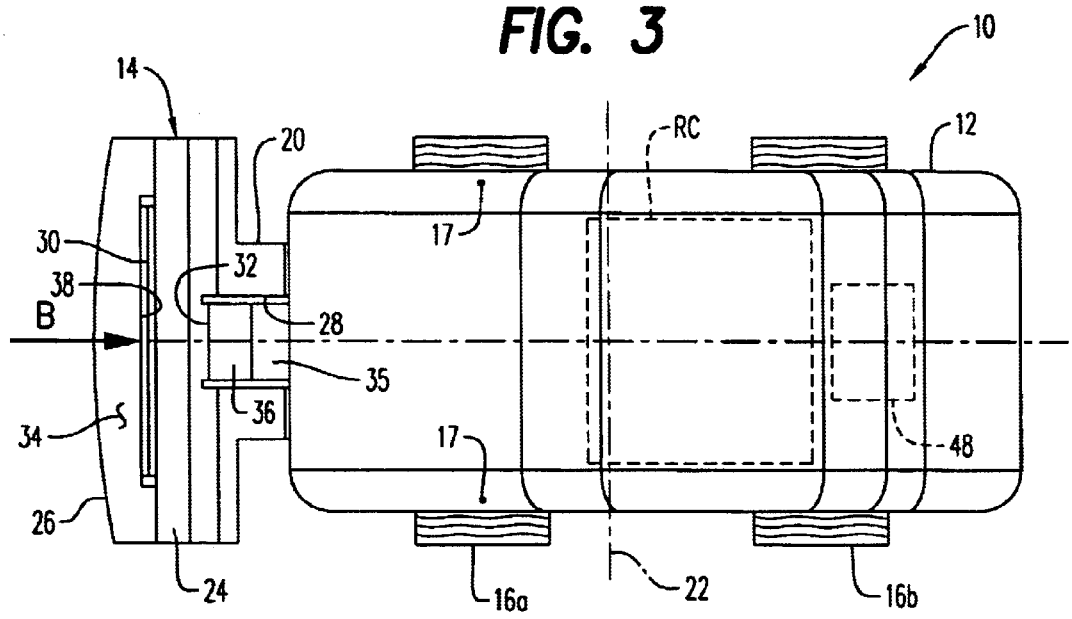
FIG. 3 is a top plan view of FIG. 1.
Figure 4:
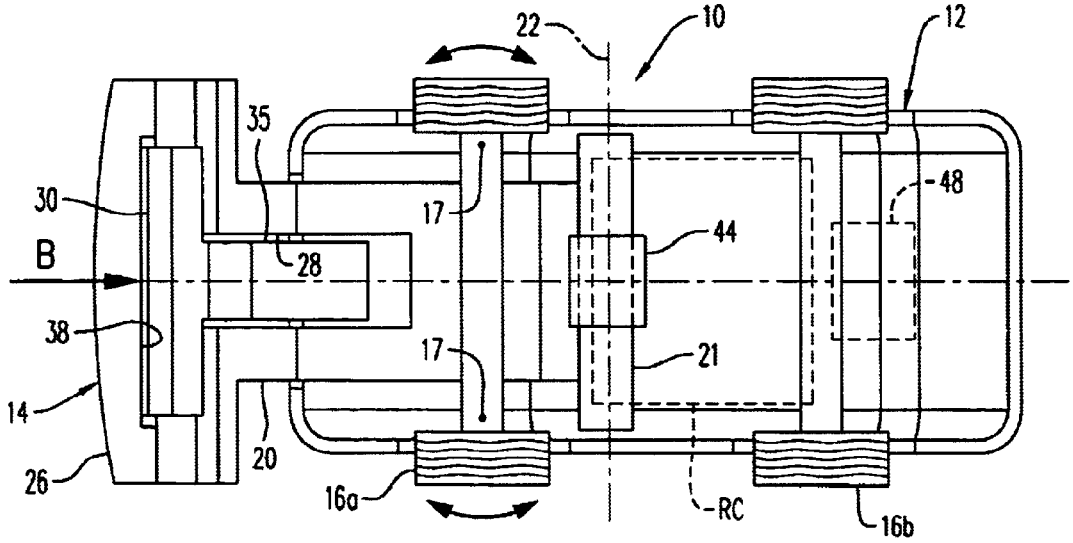
FIG. 4 is a bottom plan view of FIG. 1.

Referring now to the drawings, and particularly to FIGS. 1 to 4, the preferred embodiment of the invention is there shown generally at numeral 10. This miniature wireless control toy car 10 includes an outer molded plastic body 12 which also may serve as a chassis for supporting the internal components thereof described herebelow. Although shown as a more utilitarian configuration of the car body 12 for simplified schematic purposes, virtually any ornamental shape of the car body 12 itself may be used. Typically these miniature wireless control toy cars are of a small hand-holdable size having a length of two to three inches and a height in the range of one to one and one half inches.

Miniaturized propulsion and remote control circuitry are housed within the car body 12. An entire wireless control circuit board RC and a geared battery-powered drive mechanism 48, both shown schematically in hidden lines, are typically provided within these wireless control toy cars 10. The circuit board RC is designed to receive control signals from a separate remote control unit (not shown) and to control the drive mechanism 48 for propelling the rear wheels 16*b* of the toy car 10 forwardly and a steering servo mechanism (not shown for simplicity) which controlledly steers the front wheels 16*a* about upright steering axes 17 which effect direction control of the toy vehicle 10 in its forwardly movement.

Disposed at the forwardly end of the toy vehicle 10 is a flipping or upsetting mechanism shown generally at numeral 14. This flipping mechanism 14 includes a flipping member 20 which is pivotally connected to the car body 12 about a transverse pivotal axis 22 whereby the flipping member 20 is pivotable upwardly in the direction of arrow A in FIG. 1. To accommodate this movement, a clearance opening 18 is formed into the front surface of the car body 12 as best seen in FIG. 1.

A trigger bar 30 of a trigger member 35 provides a front impact surface which will cause the flipping mechanism 14 to operate to either flip or upset another toy vehicle or object of similar size and shape as described more fully herebelow. This trigger bar 30 is held for slidable aft translation in the direction of arrow D upon impact thereagainst in the direction of arrow B. Such impact will occur as a result of forwardly movement of the toy car 10 as it strikes against the side or rear of another toy vehicle of similar size and shape or another object as described herebelow. The trigger bar 30 is biased forwardly in the armed orientation by compression spring 46, while the flipping member 20 is biased upwardly by a wound coil spring 44 held about the pivotal support shaft 21 of the flipping member 20 about the pivotal axis 22.

When armed, a sear 32 top portion 36 of trigger member 35 bears against an elongated sear engaging bar 24 of the flipping member 20, the sear 32 being formed as a sharp horizontal edge. Spring 46 urges this sear 32 into restraining engagement with the sear engaging bar 24 when the flipping member 20 has been pivoted downwardly to an armed configuration. Upon impact of the toy car 10 during its forwardly motion against another surface, a force is exerted against the trigger bar 30 in the direction of arrow B causing the trigger member 35 to move within clearance slots 28 and 38 in the direction of arrow D to disengage the sear 32 from the sear engaging bar 24 whereupon the flipping member 20 quickly pivots about axis 22 to move a car body or object lifting portion 26 upwardly in the direction of arrow A within clearance slot 18.

Figure 5:
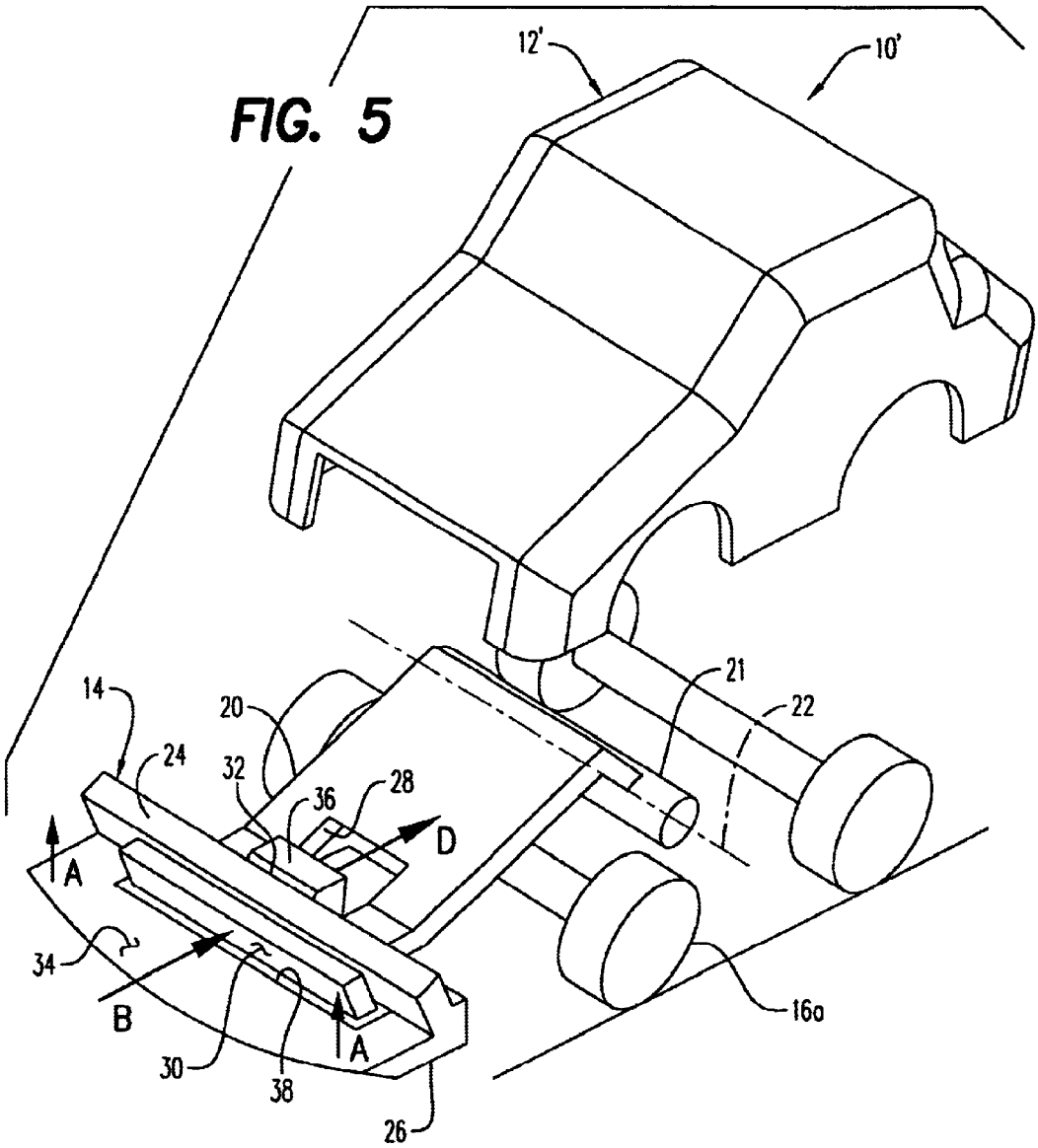
FIG. 5 is a perspective exploded view of a further simplified schematic view of the invention.

Referring additionally to FIG. 5, a perspective view of a manually propelled embodiment of the invention is there shown generally at numeral 10' which also includes an outer car body 12' absent propulsion or steering control mechanisms for economy and simplicity. In this embodiment 10', the same flipping mechanism 14 is there shown as, in part previously described. The flipping member 20 also includes a distal object engaging portion 26 which extends forwardly of the trigger bar 30 and corresponding upright impact surface thereof as shown.

Figure 6:
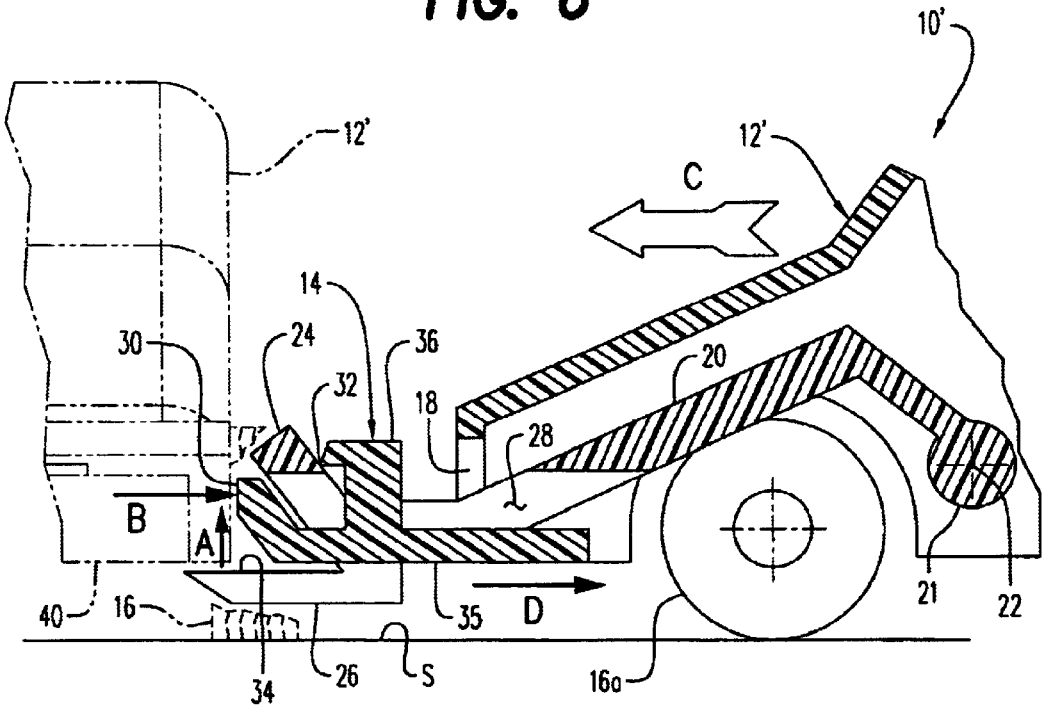
FIG. 6 is an enlarged side elevation section view of the forward portion of the invention of FIG. 5 engaged against a side portion of another vehicle of similar size and shape in phantom.

The height of the top surface 34 of this object engaging portion 26 is at a height sufficient to engage beneath the lower side or rearward body surfaces or margins of another toy vehicle shown in phantom in FIG. 6. As best seen in FIG. 1, the car body 12 includes lower side margins 40 and rear margin 42 at a predetermined height above a support surface S. The top surface 34 of the distal lifting portion 26 is preferably at a height slightly lower so that, as the toy vehicle 10 or 10' is manually or drivingly propelled forwardly in the direction of arrow C against the car body 12' of another toy vehicle, the distal car body engaging portion 26 engages beneath one of the lower or side or rear margins 40 or 42, respectively, of the second toy vehicle car body 12', the trigger bar 30 will impact against the lower side 40 or back surface 42 of the car body 12' shown in FIG. 6 in the direction of arrow B causing the trigger member 35 to move in the direction of arrow D, releasing sear 32 engagement from sear engaging bar 24 and causing the entire flipping member 20 to pivot upwardly about transverse axis 22 in the direction of arrow A. The top surface 34, being positioned beneath the side or rear surface 40 or 42, then upsets the other vehicle from its normally poised orientation atop the floor or other support surface S.

Figure 7:
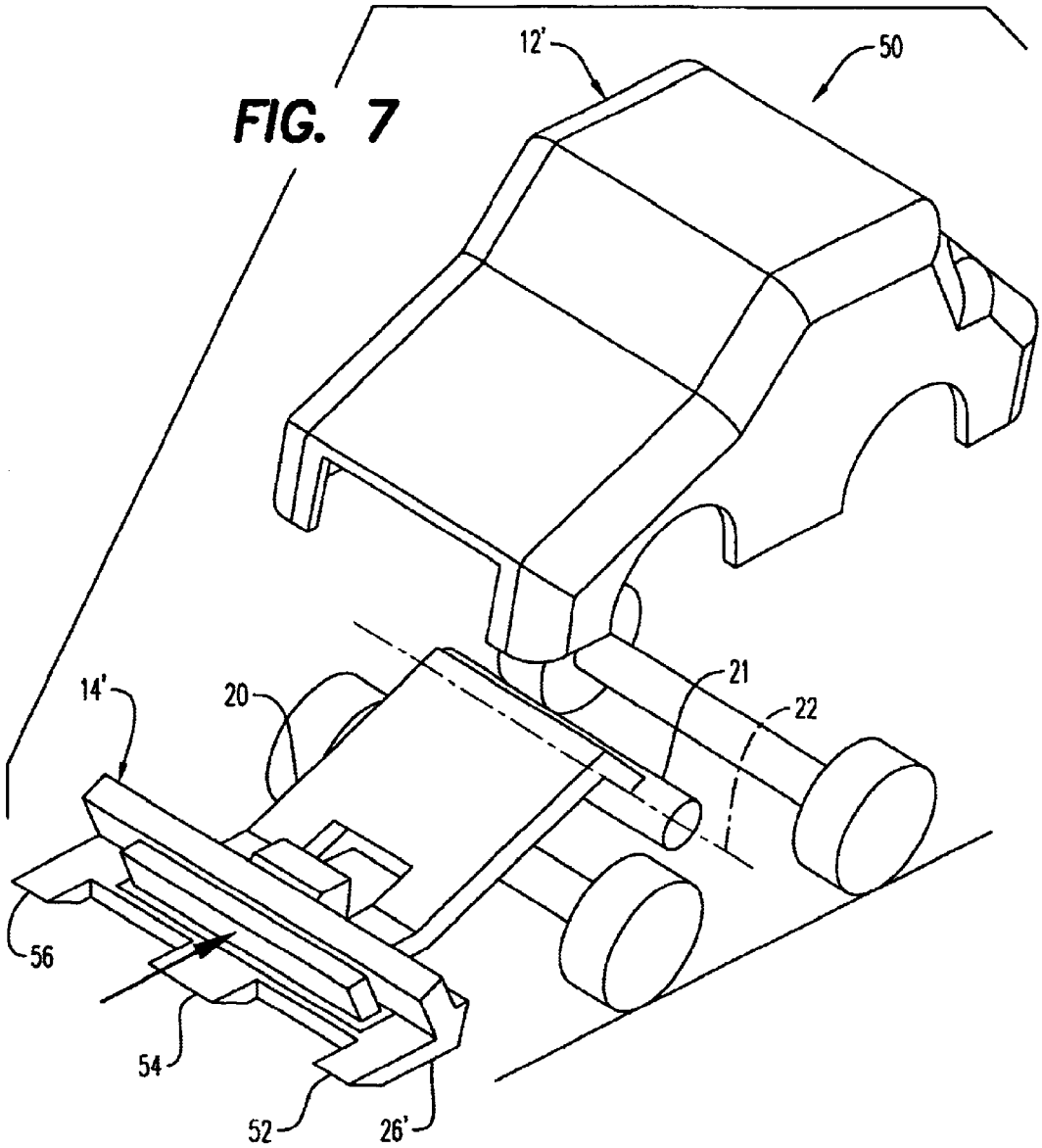
FIG. 7 is a perspective view similar to that of FIG. 5 showing an alternate embodiment of the forward portion of the flipping mechanism thereof.

Referring now to FIG. 7, an alternate embodiment of the invention is there shown generally at numeral 50 which also includes an outer car body 12' of this manually propelled embodiment 50. In this embodiment 50, the flipping mechanism 14' includes a slightly reconfigured forwardly distal object engaging portion 26' which includes a plurality of tines or forks 52, 54 and 56. By being spaced apart as shown, the ease with which one or more of these forks 52, 54 and 56 will engage beneath one of the side or rear margins 40 or 42 of the car body 12' is increased. Thus, even a diagonal impact against the trigger bar 30 effects upsetting of that other toy car or object having similarly configured and dimensioned lower margins to that of the toy car bodies previously described.

While the instant invention has been shown and described herein in what are conceived to be the most practical and preferred embodiments, it is recognized that departures may be made therefrom within the scope of the invention, which is therefore not to be limited to the details disclosed herein, but is to be afforded the full scope of the claims so as to embrace any and all equivalent apparatus and articles.

What is claimed is:

1. A miniature toy vehicle equipped to flip another toy vehicle of similar size and shape, comprising:

a molded substantially unitized toy car body supporting moveable wheels which facilitate rollably propelling said toy vehicle at another toy vehicle;

flipping member operably supported by said car body for limited pivotal movement about a transverse pivotal axis positioned centrally of said car body, and having a forwardly distal portion thereof extending forwardly of said car body at a height, when said flipping member is in a lowered armed position and biased upwardly, sufficient to engage beneath a lower side or end margin of the other toy vehicle;

a trigger member having a trigger bar and holding said flipping member in the armed position whereby, when said trigger bar strikes another toy car, said flipping member upwardly flips the other toy car.

2. A wireless controlled miniature toy vehicle equipped to flip another toy vehicle of similar size and shape, comprising:

a molded toy car body supporting front and rear wheels, a front wheel steering mechanism, a control circuit board therefor, a drive motor and a battery which facilitate rollably propelling and steering said toy vehicle at another toy vehicle;

a flipping member pivotally supported by said car body about a transverse axis and having a forwardly distal portion thereof extending forwardly of said car body at a height, when said flipping member is armed in an upwardly biased lower position, sufficient to engage beneath a lower side or end margin of another toy vehicle;

a trigger member which maintains said flipping member in the armed position whereupon, when said trigger member strikes another toy car, said flipping member moves upwardly to flip the other toy car.

3. A miniature toy vehicle equipped to flip another toy vehicle of similar size and shape upon forwardly impact therewith, comprising:

a molded toy car body supported by moveable wheels which facilitate rollably propelling said toy vehicle in a forward direction at another toy vehicle;

a flipping member pivotally supported by said car body about a single transverse axis through said car body and having a forwardly distal portion thereof extending forwardly of said car body at a height, when said flipping member is biasingly armed and ready for rapid upward independent pivotal movement about said transverse axis sufficient to engage beneath a lower side or end margin of another toy vehicle;

a trigger member which holds said flipping member in the armed position whereupon, during forward motion of said toy vehicle, when a trigger member thereof strikes another toy car, said flipping member releases said trigger member which moves upwardly to flip the other toy car.

* * * * *